US010914170B2

(12) United States Patent
Barbour

(10) Patent No.: US 10,914,170 B2
(45) Date of Patent: Feb. 9, 2021

(54) ROOF SUPPORT CONNECTOR

(71) Applicant: Joy Global Underground Mining LLC, Warrendale, PA (US)

(72) Inventor: Nicholas Graeme Barbour, Nr Wigan (GB)

(73) Assignee: Joy Global Underground Mining LLC, Warrendale, PA (US)

( * ) Notice: Subject to any disclaimer, the term of this patent is extended or adjusted under 35 U.S.C. 154(b) by 0 days.

(21) Appl. No.: 16/666,272

(22) Filed: Oct. 28, 2019

(65) Prior Publication Data

US 2020/0131906 A1 Apr. 30, 2020

Related U.S. Application Data

(60) Provisional application No. 62/752,065, filed on Oct. 29, 2018.

(51) Int. Cl.
*E21D 23/04* (2006.01)
*E21D 23/00* (2006.01)

(52) U.S. Cl.
CPC ..... *E21D 23/0409* (2013.01); *E21D 23/0034* (2013.01)

(58) Field of Classification Search
CPC ..... E21D 23/0409; E21D 23/0004; E21D 23/0052; E21D 23/0082; E21F 13/06
See application file for complete search history.

(56) References Cited

U.S. PATENT DOCUMENTS 2,843,707 A 7/1958 Berezansky et al.
3,217,608 A 11/1965 Bolton et al.
3,355,213 A 11/1967 Seddon
3,357,742 A 12/1967 Dommann et al.
3,438,210 A 4/1969 Von Hippel
3,524,321 A 8/1970 Wilkenloh et al.
3,842,966 A 10/1974 Blümenthal et al.
3,857,246 A 12/1974 Roenspies et al.
3,859,801 A 1/1975 Weirich
4,008,578 A 2/1977 Blumenthal et al.
4,010,618 A 3/1977 Walker et al.
4,102,550 A 7/1978 Campbell et al.
4,217,067 A 8/1980 Lagodka et al.
4,228,508 A 10/1980 Benthaus
4,247,226 A 1/1981 Weirich et al.
(Continued)

FOREIGN PATENT DOCUMENTS

AU 625028 B2 6/1992
AU 2016259352 A1 6/2017
(Continued)

OTHER PUBLICATIONS

International Search Report and Written Opinion for Application No. PCT/US2019/058393 dated Jan. 22, 2019 (14 pages).

*Primary Examiner* — Carib A Oquendo
(74) *Attorney, Agent, or Firm* — Michael Best & Friedrich LLP

(57) ABSTRACT

A connector for coupling a plurality of underground roof supports, each roof support including a canopy. The connector includes a guide configured to be coupled to one of the roof supports, and an actuator having a bore and a rod at least partially positioned in the bore. An end of the rod is slidably coupled to the guide. A cable has a first end coupled to the end of the rod and a second end adapted for connection to another of the roof supports.

18 Claims, 9 Drawing Sheets

(56) References Cited

U.S. PATENT DOCUMENTS

| | | | |
|---|---|---|---|
| 4,260,195 | A | 4/1981 | Hart |
| 4,274,765 | A | 6/1981 | Spence et al. |
| 4,293,248 | A | 10/1981 | Pretor et al. |
| 4,465,407 | A | 8/1984 | Plester et al. |
| 4,679,856 | A | 7/1987 | Lubojatsky et al. |
| 4,968,978 | A | 11/1990 | Stolarczyk |
| 5,087,099 | A | 2/1992 | Stolarczyk |
| 5,121,971 | A | 6/1992 | Stolarczyk |
| 5,181,934 | A | 1/1993 | Stolarczyk |
| 5,268,683 | A | 12/1993 | Stolarczyk |
| 5,824,912 | A | 10/1998 | Stankus et al. |
| 2011/0253502 | A1 | 10/2011 | Neilson et al. |
| 2013/0033085 | A1 | 2/2013 | Wade et al. |
| 2016/0362980 | A1 | 12/2016 | Knuth |
| 2017/0159431 | A1 | 6/2017 | Rimmington |

FOREIGN PATENT DOCUMENTS

| | | | |
|---|---|---|---|
| CA | 1304785 | C | 7/1992 |
| GB | 1308655 | A | 2/1973 |
| GB | 2227780 | A | 8/1990 |
| WO | 1996041932 | A1 | 12/1996 |

ROOF SUPPORT CONNECTOR

REFERENCE TO RELATED APPLICATION

This application claims the benefit of prior-filed U.S. Provisional Patent Application No. 62/752,065, filed Oct. 29, 2018, the entire contents of which are incorporated by reference.

BACKGROUND

The present disclosure relates to roof supports, and particularly to a connector between mine roof supports.

Longwall mining systems typically include a plough or shearer for excavating or cutting material from a mine face. The cut material is deposited on a face conveyor, which carriers the material away from the mine face for further processing. Multiple powered roof supports may be positioned adjacent the mine face to protect mine operators and equipment against falling material. As the mining operation progresses, each roof support is advanced to support a portion of the mine roof over the mining machine and conveyor.

SUMMARY

In one independent aspect, a connector is provided for coupling a plurality of underground roof supports, each roof support including a canopy. The connector includes a guide configured to be coupled to one of the roof supports, and an actuator having a bore and a rod at least partially positioned in the bore. An end of the rod is slidably coupled to the guide. A cable has a first end coupled to the end of the rod and a second end adapted for connection to another of the roof supports.

In another independent aspect, a connector is provided for coupling a plurality of underground roof supports, each roof support including a canopy. The connector includes an actuator having a cylinder including a bore and a rod at least partially positioned in the bore. The actuator is adapted for coupling to the canopy of one of the roof supports. A cable has a first end coupled to an end of the rod, and a second end adapted for connection to another of the other roof supports. Extension of the rod relative to the cylinder increases a tensile force exerted by the cable on the other roof support.

In yet another independent aspect, a canopy for an underground mine roof support includes a canopy body having a surface, and an actuator coupled to the surface. The actuator has a cylinder including a bore and a rod at least partially positioned in the bore. A cable has a first end coupled to an end of the rod and a second end adapted for connection to another roof support. Extension of the rod relative to the cylinder increases a tensile force exerted by the cable on the other roof support.

In still another independent aspect, a roof support system for an underground mine includes a plurality of roof supports. Each roof support includes a base configured to be coupled to a face conveyor, a jack coupled to the base, the jack being extendable and retractable relative to the base, and a canopy. An actuator is coupled to the canopy of one of the roof supports. The actuator has a cylinder including a bore and a rod partially positioned in the bore. A cable has a first end coupled to an end of the rod and a second end adapted for connection to another of the roof supports. Extension of the rod relative to the cylinder increases a tensile force exerted by the cable on the other roof support.

Other aspects will become apparent by consideration of the detailed description and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

DETAILED DESCRIPTION

Figure 1:
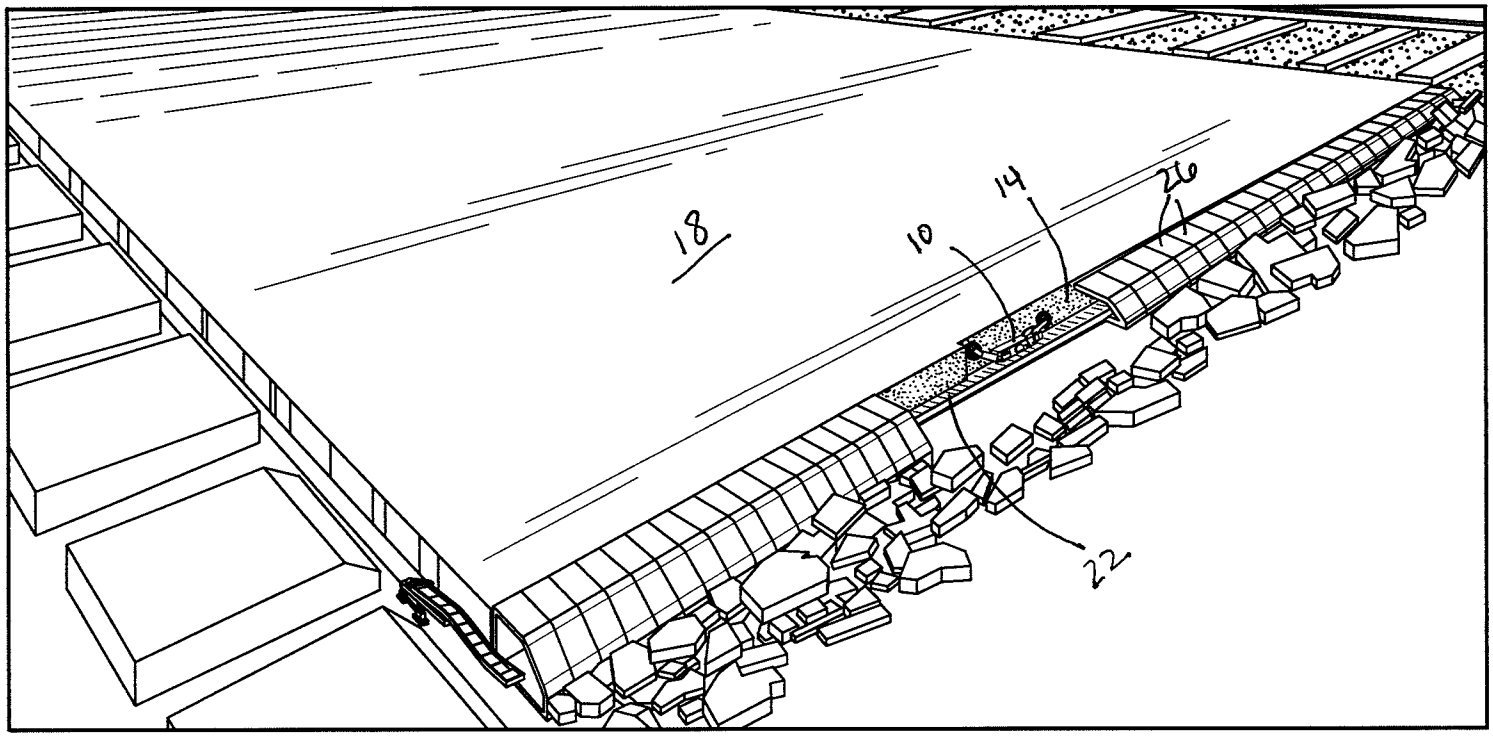
FIG. 1 is a perspective view of a mining system.
Figure 2:
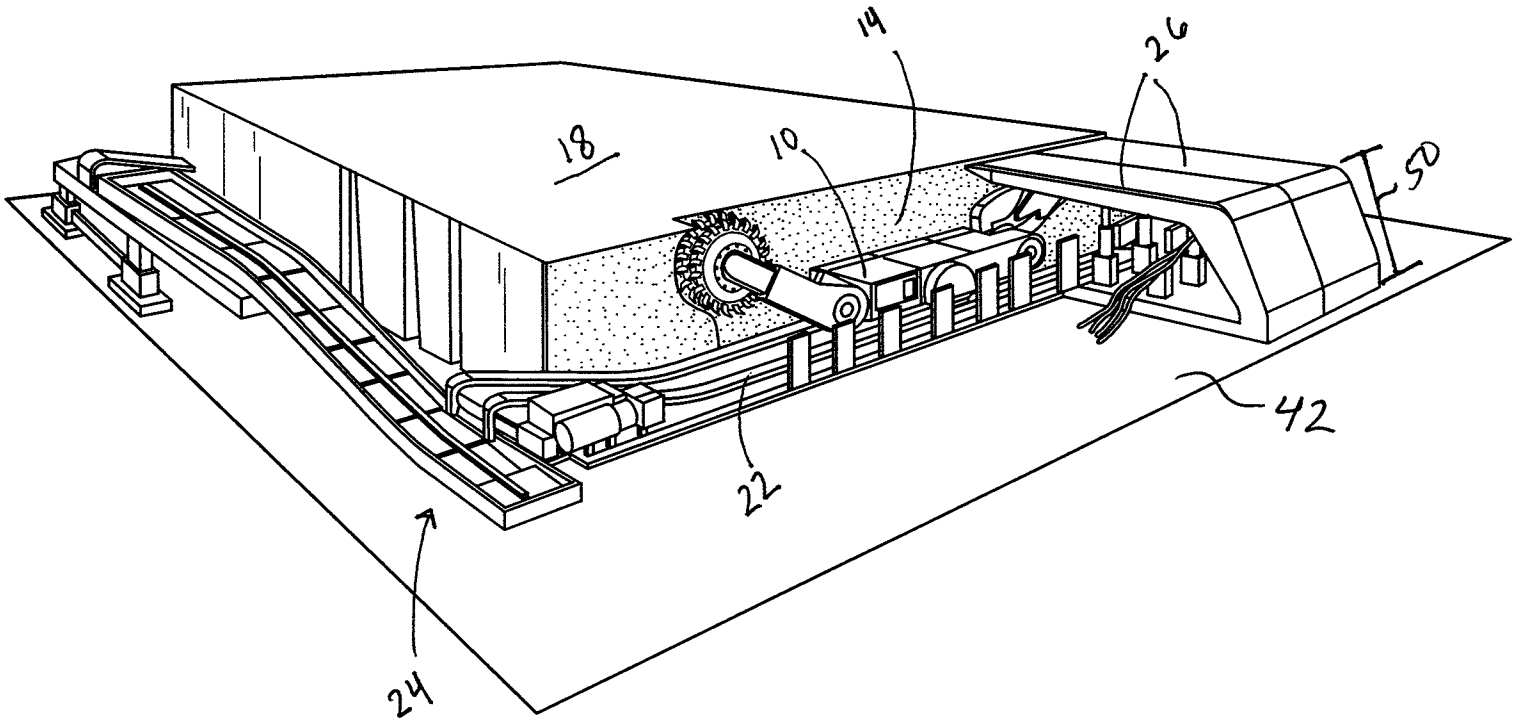
FIG. 2 is an enlarged perspective view of a portion of the mining system of FIG. 1.

FIGS. 1 and 2 illustrate a longwall mining operation. A mining machine 10 (e.g., shearer) excavates material from a mine face 14 of a mineral seam 18, and progresses through the seam 18 as material is removed. In the illustrated embodiment, the mining operation is "retreating" such that the shearer 10 progresses through the seam 18 toward a mine exit (not shown). In other embodiments, the operation may be "advancing" such that the shearer 10 progresses through the seam 18 away from the mine exit.

The mining operation further includes a face conveyor 22 for moving material excavated by the shearer 10 toward an edge of the mine face 14, wherein the cut material may be transferred to a main gate conveyor (e.g., via a beam stage loader 24-FIG. 2). In some embodiments, the face conveyor 22 is a chain conveyor including flight bars coupled between multiple chain strands. Other aspects of the structure and operation of the machine 10 and the conveyor 22 will be readily understood by a person of ordinary skill in the art.

Powered roof supports 26 are aligned in a row along the length of the mine face 14 to provide protection to operators as well as the components of the mining operation (e.g., the mining machine 10, face conveyor 22). For illustration purposes, some of the roof supports 26 are removed in FIGS. 1 and 2. The roof supports 26 are configured to form a roof support system for the underground mine.

Figure 3:
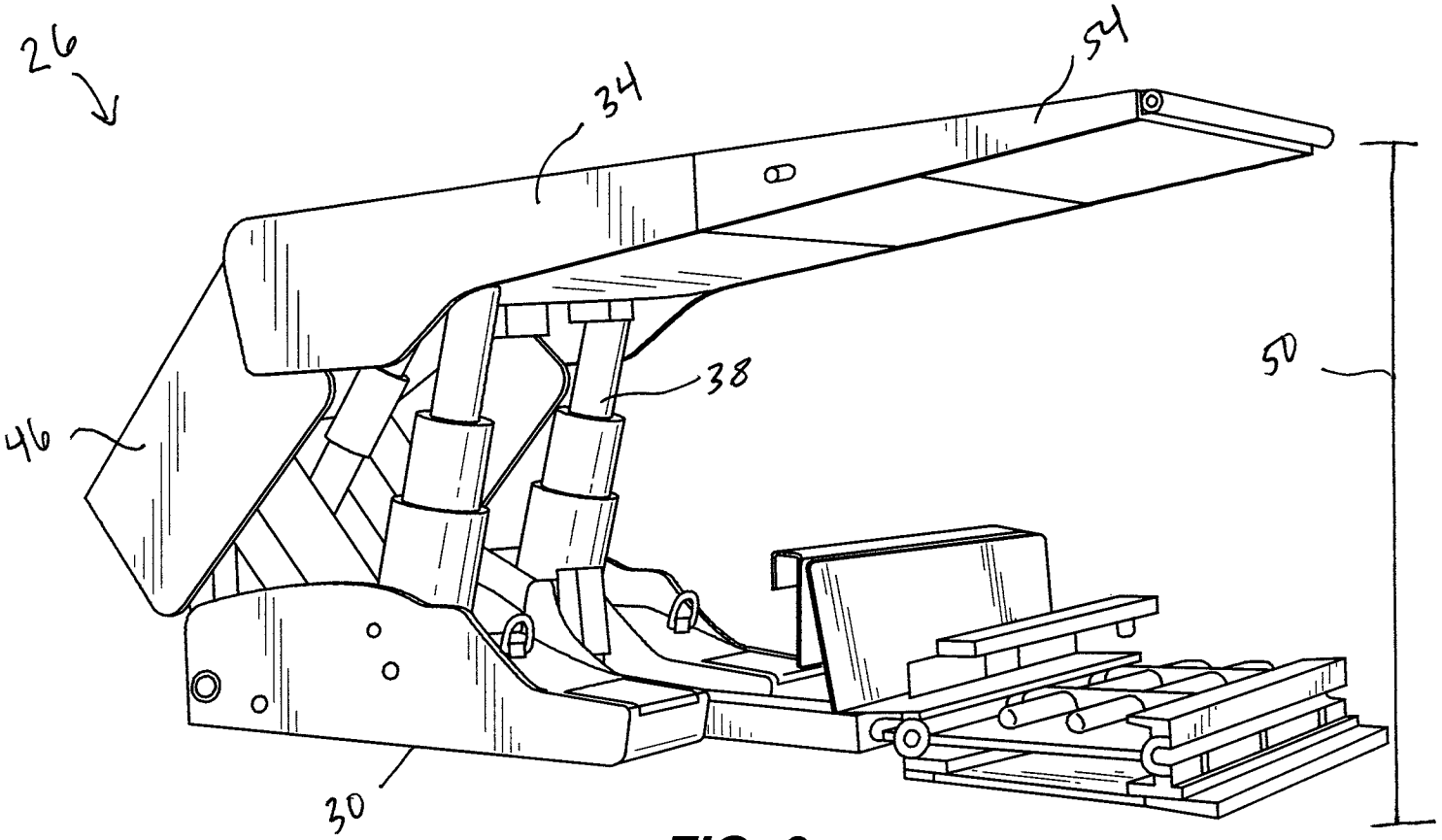
FIG. 3 is a perspective view of a roof support including a canopy.

Referring now to FIG. 3, each roof support 26 includes a base 30, a canopy 34, and actuators or jacks 38 extending between the base 30 and the canopy 34. The base 30 is positioned on a support surface or floor 42 (FIG. 2). In addition, the base 30 is configured to be coupled to the face conveyor 22 (e.g., via a ram). Each jack 38 is coupled to the base 30 and is extendable and retractable relative to the base 30. The canopy 34 is positioned adjacent a hanging wall or mine roof (not shown), and the jacks 38 bias the canopy 34 against the mine roof. In the illustrated embodiment, each roof support 26 also includes a shield 46 positioned between a rear end of the base 30 and a rear end of the canopy 34.

With reference to FIGS. 2 and 3, each of the roof supports 26 has a height 50. The height is measured from the lower surface of the base 30 to an upper surface 54 of the canopy 34. The heights of individual roof supports 26 may be adjusted to accommodate differences in a height of the mine roof. In some embodiments, the floor 42 may be oriented on an incline (e.g., upward slope, downward slope) such that a height of the canopy 34 of each of the roof supports 26 is different relative to a height of the canopy 34 of adjacent roof supports 26.

Figure 4:
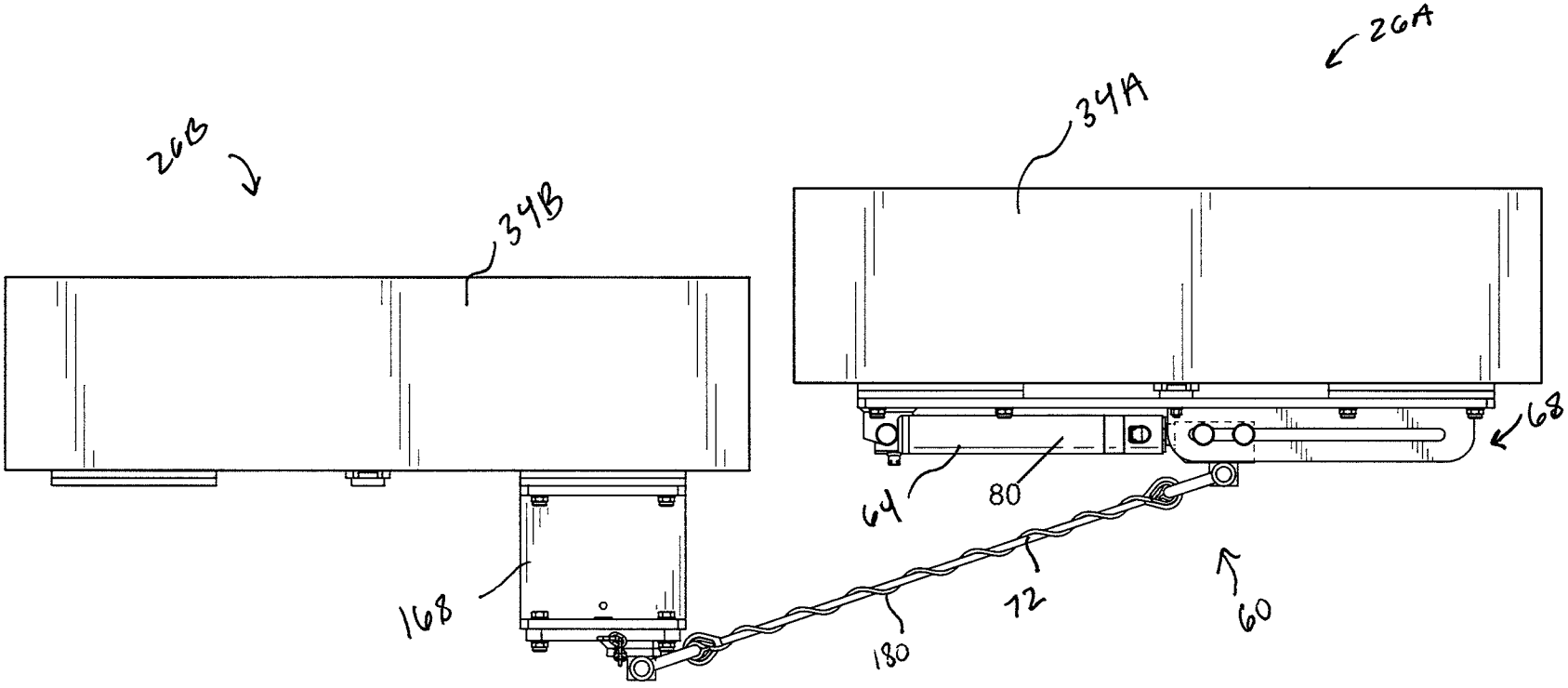
FIG. 4 is a front view of two adjacent canopies of FIG. 3 including a connector in a retracted state.
Figure 5:
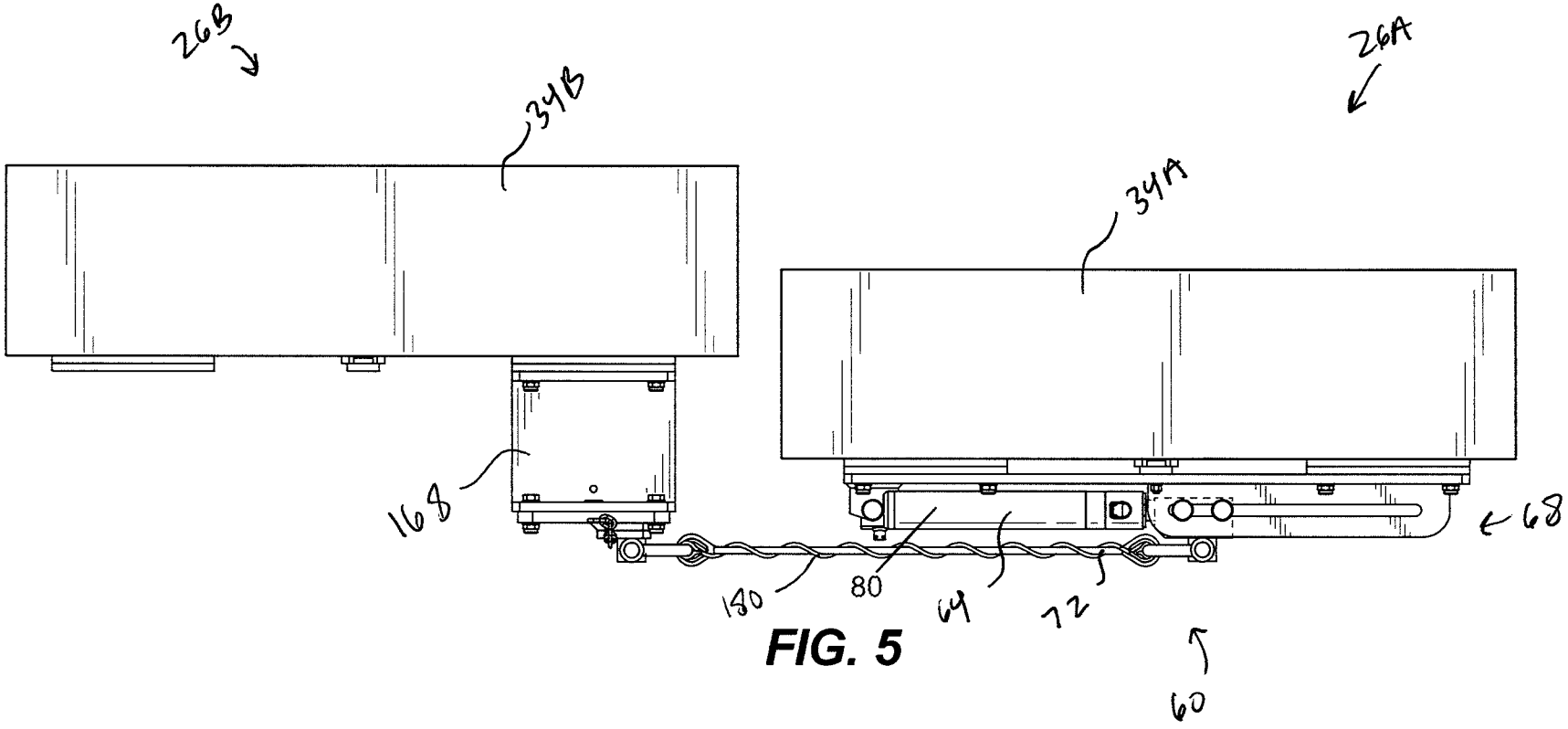
FIG. 5 is a front view of two adjacent canopies of FIG. 3 including the connector in a retracted state.
Figure 6:
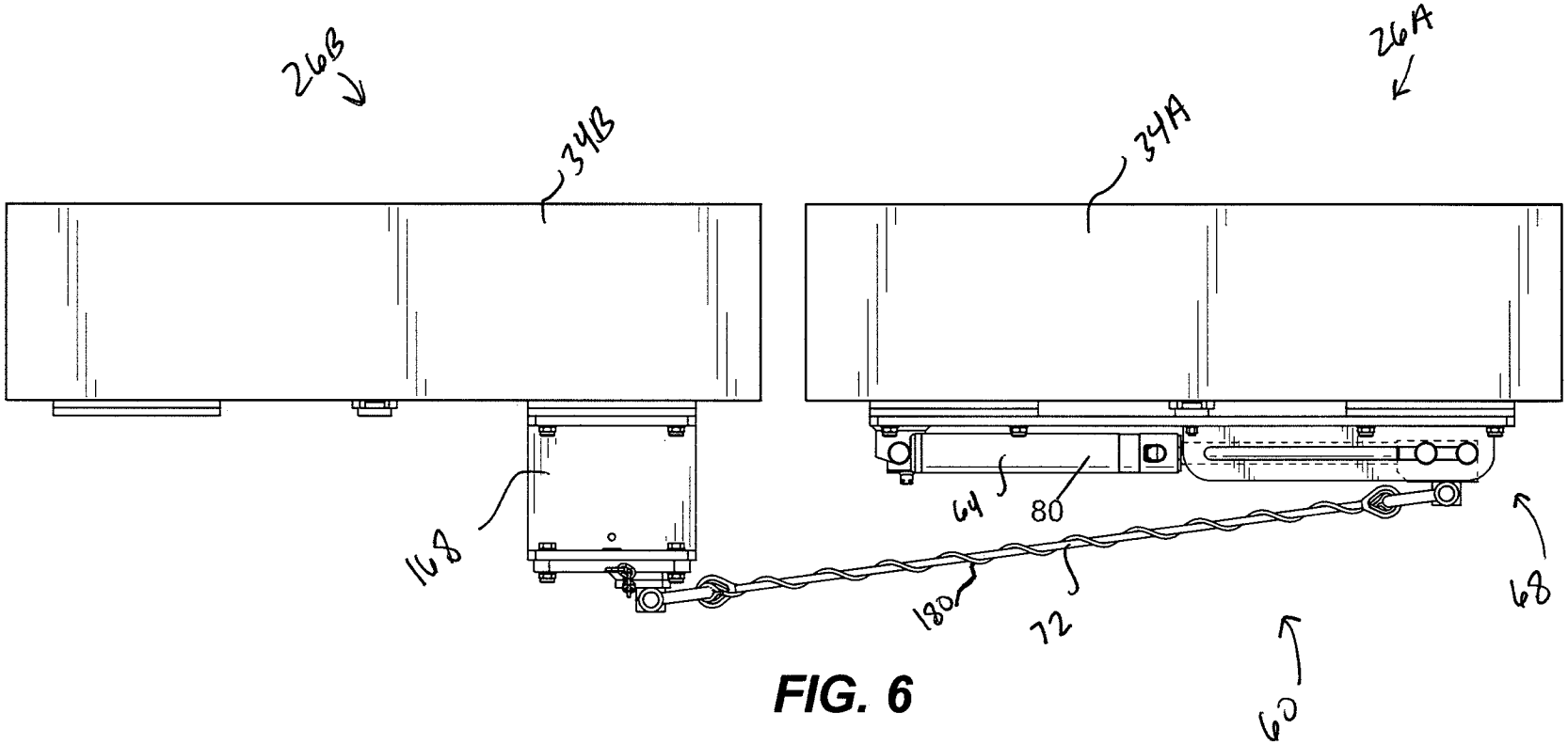
FIG. 6 is a front view of two adjacent canopies of FIG. 3 including the connector in an extended state.

FIGS. 4-6 illustrate three example conditions with respect to the height 50 of two adjacent roof supports 26A, 26B. As shown in FIG. 4, the canopy 34A of the first roof support 26A is positioned higher than the canopy 34B of a second roof support 26B (e.g., the incline has an upward slope). As shown in FIG. 5, the canopy 34A of the first roof support 26A is positioned lower than the canopy 34B of a second roof support 26B (e.g., the incline has a downward slope). As shown in FIG. 6, the canopies 34A, 34B of the respective first and second roof supports 26A, 26B are substantially at the same height 50 (e.g., the ground is level or not inclined). It is understood that, in other conditions (not shown), the difference in height 50 between two adjacent roof supports 26A, 26B may be larger or smaller.

As shown in FIGS. 4-7, a connector assembly or connector 60 couples two adjacent roof supports. The connector 60 includes an actuator 64, a guide 68, and a cable 72 coupled to the actuator 64. In the illustrated embodiment, the actuator 64 is a fluid cylinder and includes a rod 76, and an end of the rod 76 is slidably coupled to the guide 68. The guide 68 is coupled to one roof support 26A (e.g., at a canopy 34A). The cable 72 is coupled between the rod 76 and another roof support 26B (e.g., at a canopy 34B).

Figure 7:
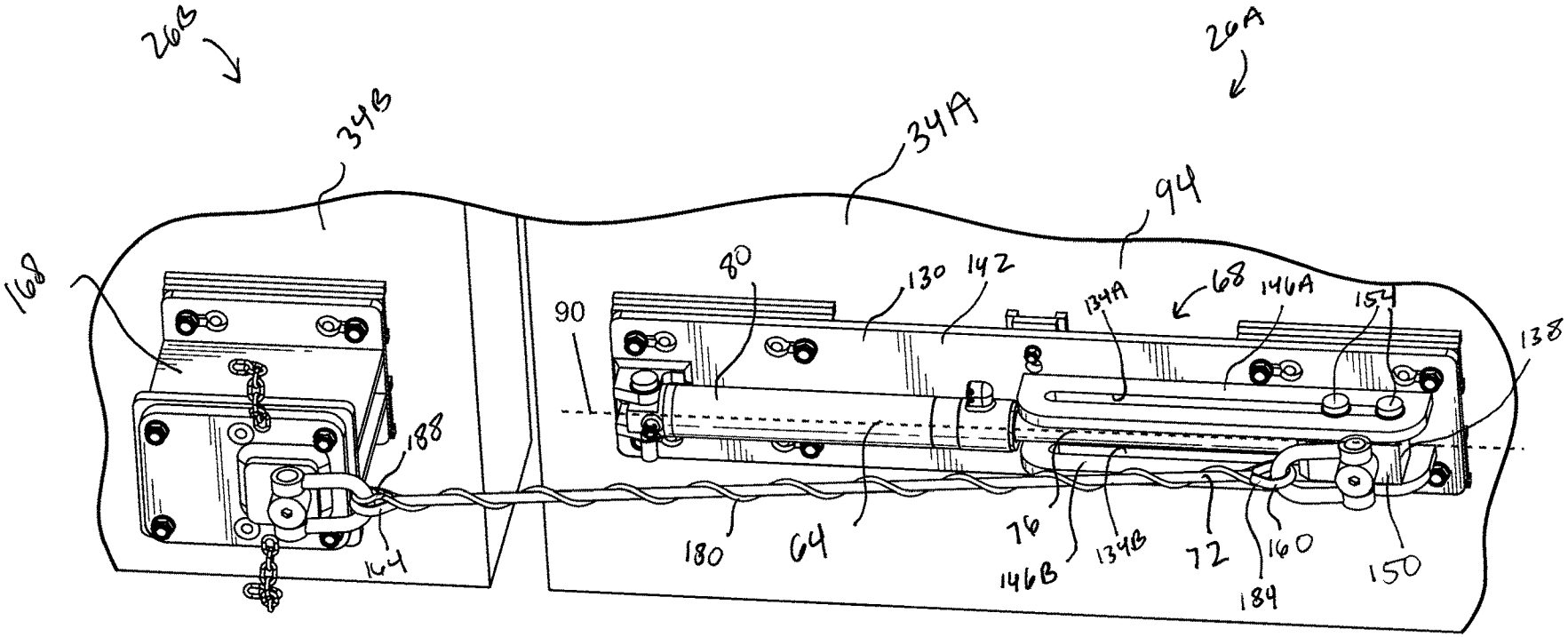
FIG. 7 is a partial perspective view of the connector.
Figure 8:
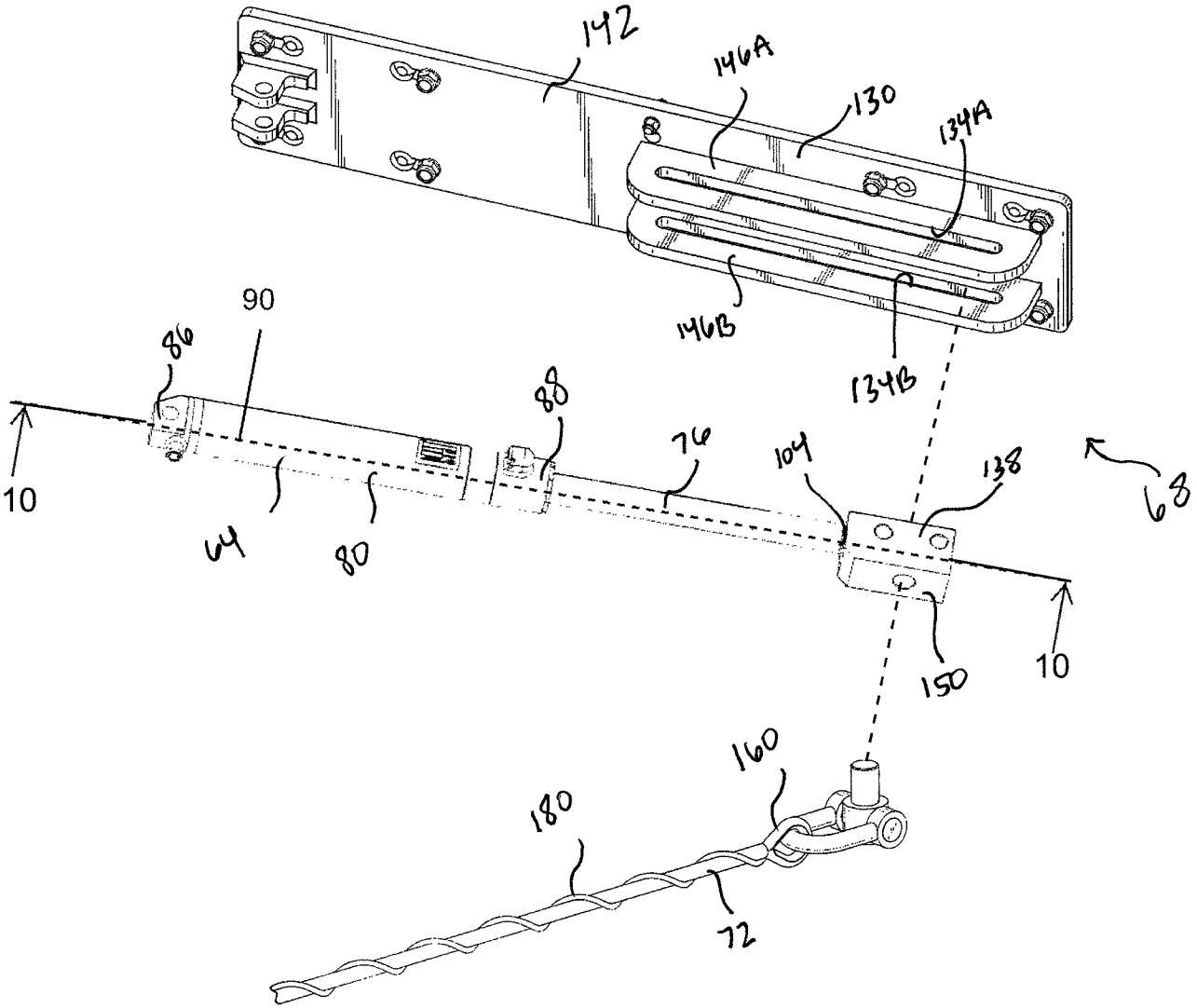
FIG. 8 is an exploded view of the connector of FIG. 7 including a guide and an actuator.
Figure 10:
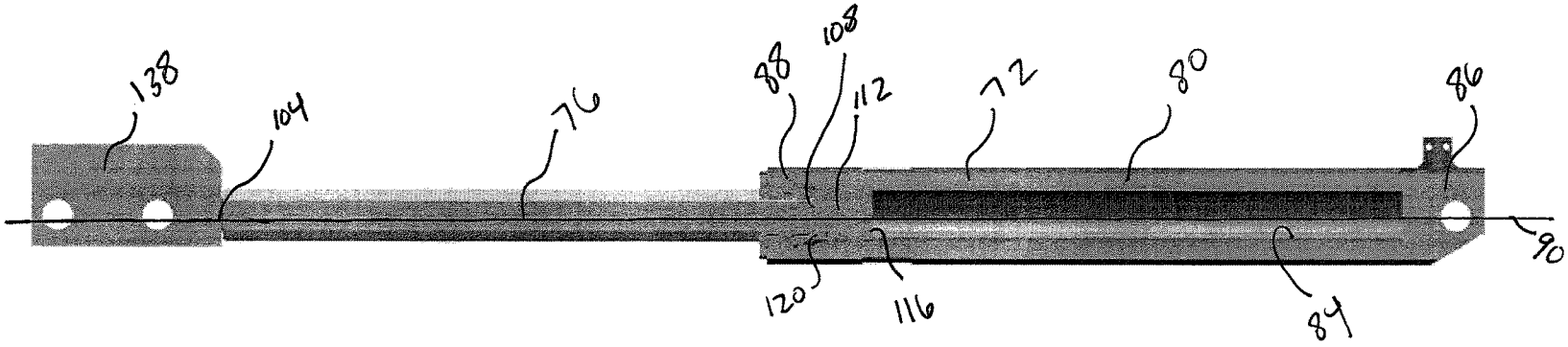
FIG. 10 is a cross-sectional view of the actuator viewed along line 10-10 in FIG. 8.

With reference to FIGS. 7, 8, and 10, the actuator 64 includes a barrel 80 (FIG. 10) having a bore 84. The barrel 80 includes a first end 86 and an opposite second end 88. The bore 84 extends along a center axis 90 (FIG. 10) extending between the first end 86 and the second end 88. In the illustrated embodiment, the actuator 64 is oriented laterally relative to the canopy 34A (FIG. 7), and the center axis 90 is oriented substantially parallel to a surface 94 of the canopy 34A. In the illustrated embodiment, the first end 86 of the actuator 64 is coupled to the canopy 34A.

As best shown in FIG. 10, the rod 76 includes a first end 104 (FIG. 10) and a second end 108 opposite the first end 104. The rod 76 is extendable and retractable relative to the barrel 80. More specifically, the rod 76 is configured to move or slide linearly along the center axis 90 in the bore 84. The first end 104 is slidably coupled to the guide 68, while the second end 108 is positioned within the bore 84 and secured to a piston 112. The piston 112 includes a cap side 116 and a rod side 120. The surface area of the cap side 116 is larger than the surface area of the rod side 120. In the illustrated embodiment, pressurized fluid within the bore 84 adjacent the cap side 116 causes the rod 76 to extend relative to the barrel 80.

Figure 9:
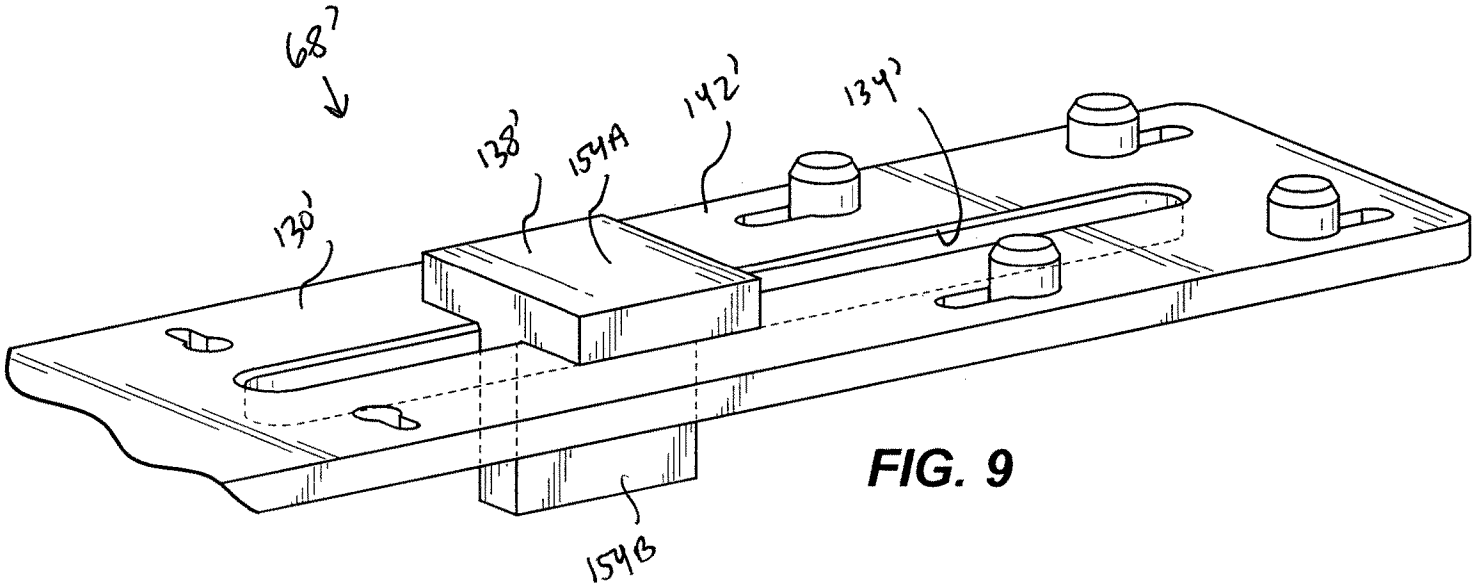
FIG. 9 is a perspective view of a guide according to another embodiment.

Referring now to FIGS. 7-9, the guide 68 includes a frame 130 rigidly coupled to the canopy 34A (e.g., on the surface 94) of the roof support 26A, 26B. In the illustrated embodiment, the frame 130 is coupled to the first roof support 26A and includes slots 134A, 134B. The connector 60 further includes a sliding block 138. The sliding block 138 is coupled to the first end 104 of the rod 76 and slidably engages the slots 134A, 134B for movement relative to the frame 130.

In the illustrated embodiment, the frame 130 includes a plate 142, and first and second legs 146A, 146B protruding from a surface of the plate 142. The plate 142 is rigidly coupled to the surface 94 of the canopy 34A. The legs 146A, 146B are spaced apart from one another and oriented parallel. Each of the first leg 146A and the second leg 146B includes an elongated slot 134A, 134B, respectively. The elongated slots 134A, 134B are oriented parallel to the center axis 90 of the bore 84.

The illustrated sliding block 138 includes a body 150 and a plurality of projections 154 (FIG. 7) extending laterally from sides of the body 150. The sliding block 138 is positioned between the first leg 146A and the second leg 146B. The projections are positioned within the slots 134A, 134B such that the sliding block 138 slidably engages both slots 134A, 134B. The projections are configured to slide within the slots 134A, 134B parallel to the center axis 90 with the movement of the rod 76. In the illustrated embodiment, the sliding block 138 includes four projections, with two on each side.

FIG. 9 illustrates a guide 68' and sliding block 138' according to another embodiment. The guide 68' includes a frame 130' having a plate 142', and the plate 142 includes an elongated slot 134'. The sliding block 138' includes a first portion 154A and a second portion 154B. The first portion 154A is positioned between a surface 158 of the plate 142' and the surface 94 of the canopy 34A (FIG. 7). The second portion 154B extends from the first portion 154A through the slot 134' protruding through the plate 142'. The sliding block 138' slidably engages the at least one slot 134' for movement along the frame 130'. More specifically, the second portion 154B is configured to slide within the slot 134' parallel to the center axis 90.

Referring again to FIGS. 7 and 8, the cable 72 includes a first end 160 and a second end 164 opposite the first end 160. The first end 160 is coupled to the sliding block 138. For example, the first end 160 can be coupled to the body 150 of the sliding block 138. In the embodiment of FIG. 9, the first end 160 can be coupled to the second portion 154B of the sliding block 138'.

As shown in FIG. 7, the second end 164 of the cable 72 is coupled to the other roof support 26B. In the illustrated embodiment, the second end 164 of the cable 72 is coupled to the canopy 34B of the roof support 26B that is adjacent the roof support 26A on which the actuator 64 is supported. A mounting feature or block 168 is rigidly coupled to the canopy 34B of the second roof support 26B and is pivotably coupled to the second end 164 of the cable 72. In other embodiments, the second end 164 may be coupled adjacent the surface of the canopy 34A, 34B.

Furthermore, in the illustrated embodiment, the connector 60 includes a cord 180 having a first end 184 and an opposite second end 188. The first end 184 is coupled to the first end 104 of the rod 76 (i.e., via the sliding block 138), and the second end 188 is connected adjacent the coupling between the cable 72 and the other roof support 26B. The second end 188 is connected to the other roof support 26B independent of the cable 72. The cord 180 can be helically wound around the cable 72 from the first end 184 to the second end 188. In some embodiments, the cord 180 provides a safety catch of the connector 60.

In some embodiments, a controller (not shown) can be coupled to the actuator 64 to control the movement of the rod 76 relative to the barrel 80. More specifically, the controller selectively controls supply of the pressurized fluid to the bore 84 for exerting pressure on the piston 112 coupled to the rod 76.

In some embodiments, the actuator 64 is configured such that the extension of the rod 76 moves the sliding block 138, and therefore the first end 160 of the cable 72 away from the adjacent roof support 26B. The extension of the rod 76 relative to the barrel 80 increases a tensile force exerted by the cable 72 on the second roof support 26B. As such, the extension of the rod 76 exerts a force to pull or bias the canopy 34B of the second roof support 26B toward the first roof support 26A. The force or bias of the second roof support 26B toward the first roof support 26A is configured to inhibit separation of the first and second roof supports 26A, 26B and prevent the roof supports from leaning too far (e.g., when the roof supports are on an inclined surface), thereby preventing toppling.

Pressurized fluid within the bore 84 acts on the cap side 116 to extend the rod 76 relative to the barrel and increase the tension on the cable 72. Among other things, the surface area of the cap side 116 of the piston 112 is larger than the surface area of the rod side 120, permitting the connector 60 to produce a greater force to prevent toppling than a conventional connector. Alternatively, the connector 60 may utilize a smaller diameter piston and barrel 80 and/or lower fluid pressures than a conventional connector while still providing the same force/tension in the cable 72 to prevent toppling.

In operation, as shown in FIGS. 4-6, the rod 76 is actuated from the first position (FIG. 4 or 5) to the second position (FIG. 6). In the first position, a substantial portion of the rod 76 is within the cylinder 80 such that the first end 104 of the rod 76 is near the second end 88 of the barrel 80. The first end 104 (FIG. 10) of the rod 76 is extended or moved away (as shown in FIG. 6) from the second end 88 of the barrel 80 by the pressure exerted on the cap side 116 of the piston 112 such that the first end 104 of the rod 76 is farthest from the second end 88 of the cylinder 80. Extension of the rod 76 from the first position to the second position, increases the tensile force exerted by the cable 72, coupled to the rod 76, on the second roof support 26B such that the canopy 34B of the second roof support 26B is pulled toward the first roof support 26A. As such, the pressure exerted on the cap side 116 increases the tensile force exerted by the cable 72.

The extension of the rod 76 may increase tension in the cable 72 to bias the canopies 34A, 34B toward one another even if the floor 42 is inclined (e.g., upward slope, downward slope). For example, when the mine floor is inclined on a downward slope (FIG. 5), the connector 60 coupled to the canopy 34A of the first roof support 26A, may exert a biasing force on the canopy 34B of the second roof support 26B to prevent the canopy 34A from falling away from the canopy 34B. Similarly, when the incline has an upward slope (FIG. 4), the connector 60 may exert a biasing force on the canopy 34B of the second roof support 26B upward.

If the cable 72 were to break under load, the actuator 64 is restrained against recoil (e.g., by the guide 68), thereby increasing safety during operation.

The embodiments described above and illustrated in the figures are presented by way of example only and are not intended as a limitation upon the concepts and principles presented herein. As such, it will be appreciated that variations and modifications exist within the scope and spirit of one or more independent aspects as described and claimed.

What is claimed is:

1. A connector for coupling a plurality of underground roof supports, each roof support including a canopy, the connector comprising:

a guide configured to be coupled to one of the roof supports, the one of the roof supports moveable in a direction of advance;

an actuator including a bore and a rod at least partially positioned in the bore, a first end of the rod being slidably coupled to the guide, a second end of the rod opposite the first end positioned in the bore, an axis of the rod extending through the first end and the second end, the actuator positioned relative to the one of the roof supports such that the axis is oriented transverse to the direction of advance; and a cable having a first end coupled to the first end of the rod and a second end adapted for connection to another of the roof supports.

2. The connector of claim 1, further comprising a controller coupled to the actuator, the controller controlling the movement of the rod relative to the cylinder.

3. The connector of claim 1, wherein the actuator includes a piston positioned in the bore, the piston including a rod side coupled to the second end of the rod, the piston including a cap side opposite the rod side, wherein pressure exerted on the cap side increases a tensile force exerted by the cable.

4. The connector of claim 1, wherein the guide includes a frame rigidly coupled to the canopy of the one roof support and includes at least one slot, wherein a sliding block is coupled to the first end of the rod and slidably engages the at least one slot for movement along the frame.

5. The connector of claim 4, wherein the at least one slot includes a pair of slots, the frame including a first leg and a second leg spaced apart from the first leg, wherein the first leg includes one slot and the second leg includes the other slot, and wherein the sliding block is positioned between the first leg and the second leg and slidably engages both slots.

6. The connector of claim 4, wherein the frame includes a plate having the at least one slot, wherein the sliding block includes a first portion and a second portion, the first portion positioned adjacent the plate, the second portion extending from the first portion through the slot, and wherein the first end of the cable is coupled to the second portion.

7. The connector of claim 1, further comprising a cord including a first end coupled to the end of the first rod and a second end adapted for connection to the other roof support independent of the cable, the cord helically wound around the cable from the first end to the second end for providing a safety catch of the connector.

8. The connector of claim 1, wherein a sliding block is coupled to the first end of the rod, wherein the first end of the cable is coupled to a side of the sliding block opposite a side coupled to the first end of the rod, and wherein extension of the rod moves the first end of the cable away from the other roof support via the sliding block.

9. A connector for coupling a plurality of underground roof supports, each roof support including a canopy, the connector comprising:

an actuator including a cylinder including a bore and a rod at least partially positioned in the bore, the actuator adapted for coupling to the canopy of one of the roof supports, each roof support moveable in a direction of advance; and a cable having a first end coupled to an end of the rod and a second end adapted for connection to another of the other roof supports, extension of the rod relative to the cylinder increasing a tensile force exerted in a lateral direction relative to the direction of advance by the cable on the other roof support.

10. The connector of claim 9, further comprising a sliding block is coupled to the end of the rod and to the first end of the cable.

11. The connector of claim 10, further comprising a guide, wherein the guide includes at least one slot, the sliding block engaging the at least one slot for movement relative to the guide, the guide rigidly coupled to the canopy of one of the roof supports.

12. The connector of claim 9, wherein the actuator includes a piston positioned in the bore, the piston including a rod side and a cap side opposite the rod side, the rod side coupled to an end of the rod opposite the sliding block, the cap side having a larger surface area than the rod side, wherein pressure exerted on the cap side causes the rod to extend.

13. The connector of claim 9, wherein the one of the roof supports is a first roof support and the other roof support is a second roof support, wherein the extension of the rod pulls the second roof support toward the first roof support, wherein the canopy of one of the first roof support and the second roof support is at a height different than a height of the canopy of the other of the first roof support and second roof support, and wherein the extension of the rod changes the height of the canopy of one of the first roof support and the second roof support relative to the height of the canopy of the other of the first roof support and the second roof support.

14. A canopy for an underground mine roof support, the canopy comprising:

a canopy body including a surface, the canopy body defining a longitudinal axis, the roof support moveable in a direction of advance along the longitudinal axis;

an actuator coupled to the surface, the actuator having a cylinder including a bore and a rod at least partially positioned in the bore, the bore extending along a center axis, and the actuator positioned on the canopy body such that the center axis is oriented transverse to the longitudinal axis; and a cable having a first end coupled to an end of the rod and a second end adapted for connection to another roof support, extension of the rod relative to the cylinder increasing a tensile force exerted by the cable on the other roof support.

15. The canopy of claim 14, wherein the cylinder is rigidly coupled to the surface of the canopy body.

16. The canopy of claim 14, wherein the cylinder includes a first end and a second end, wherein the center axis extends through the first end and the second end, and wherein extension of the rod is linear relative to the center axis.

17. The canopy of claim 14, further comprising a sliding block coupled to the end of the rod and to the first end of the cable.

18. The canopy of claim 14, wherein the roof support is a first roof support and the another roof support is a second roof support, wherein the extension of the rod pulls the second roof support toward the first roof support, wherein the canopy of one of the first roof support and the second roof support is at a height different than a height of the canopy of the other of the first roof support and second roof support, and wherein the extension of the rod changes the height of the canopy of one of the first roof support and the second roof support relative to the height of the canopy of the other of the first roof support and the second roof support.

* * * * *